United States Patent [19]

Cochran

[11] Patent Number: 4,863,643

[45] Date of Patent: Sep. 5, 1989

[54] APPARATUS FOR DISSOLUTION OF GAS IN LIQUID

[76] Inventor: David W. Cochran, Rt. 1, P.O. Box 317, Talking Rock, Ga. 30175

[21] Appl. No.: 243,625

[22] Filed: Sep. 13, 1988

[51] Int. Cl.[4] ..... B01F 3/04

[52] U.S. Cl. ..... 261/76; 261/DIG. 75

[58] Field of Search ..... 261/DIG. 75, 76

[56] References Cited

U.S. PATENT DOCUMENTS

| | | | |
|---|---|---|---|
| 3,900,420 | 8/1975 | Sebba | 261/76 |
| 4,042,510 | 8/1977 | Sullins | 261/DIG. 75 |
| 4,043,771 | 8/1977 | Anand | 261/361 |
| 4,098,820 | 7/1978 | Couteau et al. | 261/DIG. 75 |
| 4,466,928 | 8/1984 | Kos | 261/DIG. 75 |
| 4,486,361 | 12/1984 | Durot et al. | 261/77 |
| 4,639,340 | 1/1987 | Garrett | 261/DIG. 75 |
| 4,735,750 | 4/1988 | Damann | 261/DIG. 75 |

FOREIGN PATENT DOCUMENTS

| | | | |
|---|---|---|---|
| 249654 | 4/1926 | United Kingdom | 261/DIG. 75 |

*Primary Examiner*—Tim Miles

*Attorney, Agent, or Firm*—Harry I. Leon

[57] ABSTRACT

An apparatus without any moving parts for dissolving gas in a liquid. Once introduced into the apparatus, a liquid is forced through a plurality of orifices in a plate which breaks the flow apart. Downstream of but close to this plate, a gas at a higher pressure than the liquid is injected into the liquid, forming a gas/liquid mixture. This mixture then flows down a first mixing tube at the end of which a deflector cap turns the flow approximately 180 degrees and throws it against a flat disk disposed close to the outlets of the first mixing tube. The force with which the impinging mixture strikes the deflector cap and then the disk causes large bubbles to break apart into smaller ones. The gas/liquid suspension then enters a second and longer tube surrounding the first mixing tube, where further continuous mixing by flow forces occurs. If any of the gas bubbles remaining in the flow are large enough to escape from the flow in the second mixing tube, these bubbles rise to the top of the liquid surface there and coalesce with the gas about to be injected into the liquid downstream of the orifice plate. The gas/liquid suspension itself is ultimately discharged from the second mixing tube through a feed tube to a submerged location at which the suspension is to be used. A control valve is placed at the submerged end of the feed tube to allow the flow pressure to be kept as high as possible as an aid in keeping the gas in solution.

6 Claims, 2 Drawing Sheets

Fig. 6.
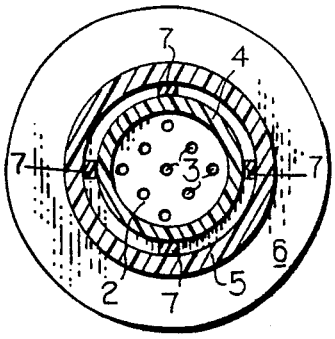
Fig. 5.
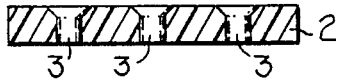
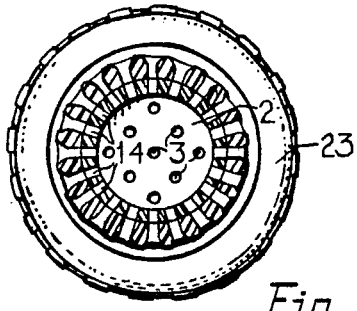
Fig. 4.
Fig. 2.
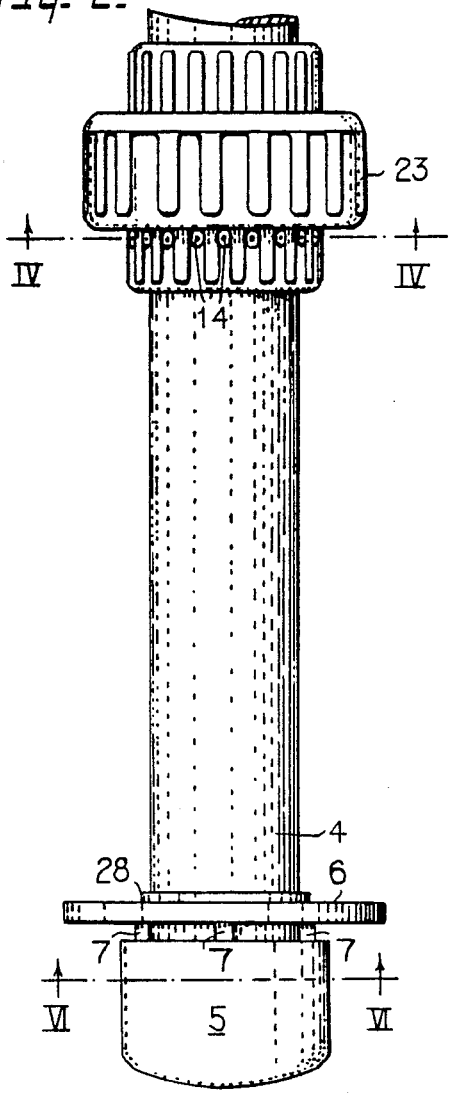
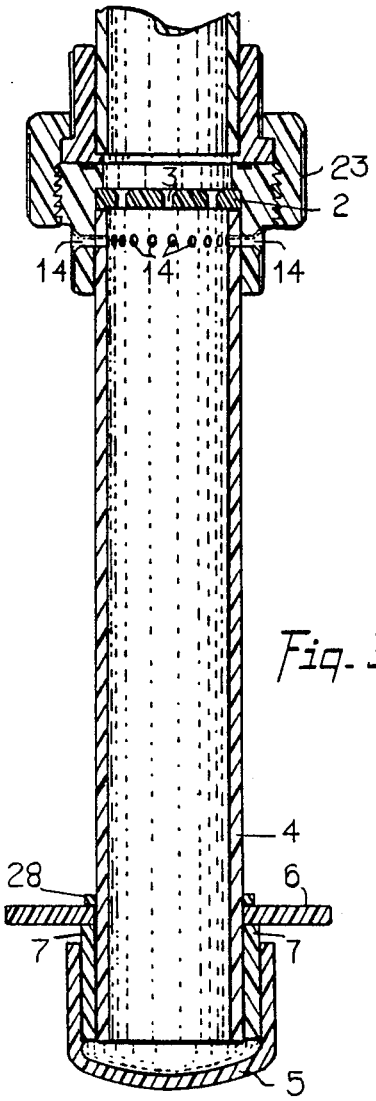
Fig. 3.

APPARATUS FOR DISSOLUTION OF GAS IN LIQUID

BACKGROUND OF THE INVENTION

This invention relates to the field of mixing a gas in a liquid. The basic problem is to get as large a fraction of the injected gas into solution as possible for as long a retention time as possible. This objective is accomplished in part by entraining the gas as microfine bubbles within the liquid so that the area of the liquid-gas interface is maximized.

A recent process and device for so entraining a gas were disclosed by Damann, U.S. Pat. No. 4,735,750. In Damann's combination, gas is brought into contact with a liquid after it is sprayed through a plurality of small nozzles having throat diameters of only 2 mm. The use of such small nozzles, however, gives rise to the problem of nozzle clogging in some applications. In the oxygenation of pond water, for example, Damann's device has been found, in repeated tests, to clog readily with detritus, algae, grass and fish waste.

Not only are the sizes of the gas bubbles in a gas/liquid suspension a function of the degree of mixing (which is related to the nozzle size and configuration) but also of the static pressure of the gas/liquid mixture. When the pressure is high, the gas bubbles tend to be smaller and to have longer retention times in the liquid. As the pressure of the mixture decreases, the bubbles tend to expand, coalesce, float to the surface and escape the liquid.

For use in shallow fish ponds, the larger the bubbles released from an aeration device the higher the probability that the gas might escape the pond before the gas ever has a chance to be utilized there. The cited prior art teaches, however, that to keep the proper fluid level in the aeration device, a control valve positioned a considerable distance upstream of the actual discharge outlet should be used. Such a position for the control valve leads to a lowering of the pressure of the gas/liquid mixture aft of the valve, thereby allowing the gas bubbles entrained in the mixture to enlarge.

SUMMARY OF THE INVENTION

In an apparatus for the dissolution of a gas in a liquid having means for breaking a flow of the liquid into a plurality of small streams, means for introducing the gas into these small streams so that some of the gas dissolves in them and means for recombining the streams and for static mixing of the resultant flow, the improvement according to the present invention comprises means for suddenly turning the resultant flow so that large bubbles entrained therein that move more slowly than the flow stream cannot make the turn. Further, the improvement includes a splatter wall against which that portion of the liquid/gas mixture which actually completes the turn can be made to impinge with a force capable of breaking apart the larger gas bubbles still remaining in the flow.

Moreover, the present invention eliminates the need for small nozzles that plug easily. Employing as it does multiple orifices with diameters of approximately ¼ inch to break the flow into smaller streams, the present invention virtually eliminates clogging problems. Indeed, in numerous tests involving the oxygenation of pond water, the orifices in the present invention let the solids through without any clogging.

The improved apparatus provides obstacles to the flow of the gas/liquid mixture such that it is necessarily churned violently. The agitation causes more of the gas to be entrained as microfine bubbles which eventually dissolve in the liquid and less of the gas to separate from the gas/liquid mixture as large gas bubbles returning to the gas stream to be reintroduced into the liquid than is the case in the prior art. Indeed, a substantial difference in the amount of oxygen absorbed by pond water has been measured in actual tests using the present invention and Damann's device (U.S. Pat. No. 4,735,750; tradename "Aquatector"). These tests, which were conducted using the same water pump, plumbing, and oxygen supply, showed that the present invention delivered approximately 15 percent more oxygen to the pond water. A summary comparing the performances of the two devices is given in the table below:

| AMOUNT OF OXYGEN ABSORBED, liters per minute | | |
|---|---|---|
| WATER TEMPERATURE, F. | AQUATECTOR | PRESENT INVENTION |
| 42 | 10.0 | 11.5 |
| 59 | 7.8 | 9.0 |
| 70 | 7.0 | 8.0 |

The tests were repeated numerous times with the same results. The improvement is believed to be due to the fineness in size and the larger number of oxygen gas bubbles of the present invention.

Further, the improved apparatus according to the present invention uses a control valve placed at the discharge outlet of flow line so that the pressure in this line is kept as high as possible, thereby helping to keep the gas bubbles small in size and retain them in solution until the gas/liquid suspension can be placed in the body of liquid in which the gas is to be utilized. Indeed, with the present invention, the discharge point can be situated as much as 300 feet from the entrance to the flow line without any significant loss of oxygen, while with devices having a control valve proximate this entrance, actual tests on the aeration of fish ponds have shown that the discharge point needs to be within a few feet of this entrance for good results.

BRIEF DESCRIPTION OF THE DRAWINGS

FIG. 2 is a frontal elevation view of the venturi assembly drawn on an enlarged scale in which the assembly is shown approximately one-half of its actual size;

FIG. 3 is a longitudinal cross-section through the venturi assembly according to FIG. 2;

FIG. 4 is a cross-section IV—IV from FIG. 2;

FIG. 5 is a transverse cross-section of the orifice plate on a further enlarged scale; and FIG. 6 is a cross-section VI—VI from FIG. 2.

DETAILED DESCRIPTION OF THE PREFERRED EMBODIMENT

Figure 1:
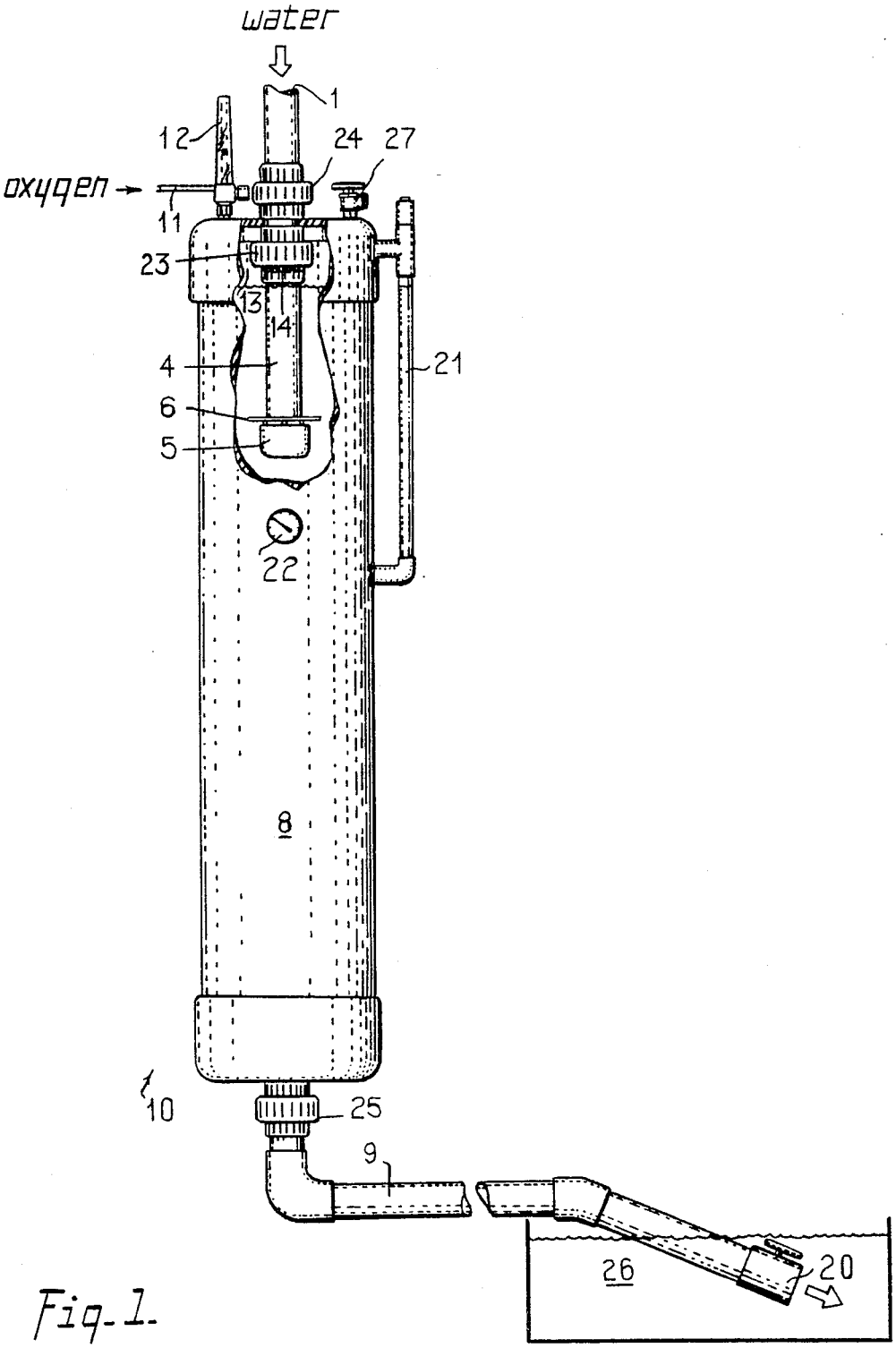
FIG. 1 is a view in elevation of the apparatus according to the present invention in which a section of the holding tank has been cut away to show the venturi assembly.

In the drawings, an apparatus for dissolution of gas in a liquid according to the present invention is indicated generally by the numeral 10. The apparatus 10 comprises a vertical holding tank 8 that encloses a venturi assembly with a mixing tube 4 within which a gas can be entrained in a liquid.

In operation, a liquid such as water is pumped into an inlet 1 connected by an union 24 to the venturi assembly and passed through a plurality of orifices 3 in a plate 2 mounted upstream of the mixing tube 4. As the liquid passes through the orifices 3, its velocity is increased and the static pressure of the stream is decreased. Simultaneously, a gas such as oxygen is introduced into the apparatus 10 at inlet 11. The gas, which is maintained at a higher pressure than the liquid at inlet 1, flows into a cavity 13 within the holding tank 8. From the cavity 13, which is bounded below by the liquid level in the tank 8, the gas passes through a plurality of holes 14 in the venturi assembly and comes into contact with the liquid that has just been forced through the orifices 3. Since the gas enters the tube 4 at a higher pressure than the liquid, the gas tends to saturate the liquid as it streams in.

Immediately downstream of the plate 2, the gas bubbles present in the flow exhibit a wide variation in size. But these gas bubbles, acted upon by flow forces, come into contact with an ever larger amount of liquid and tend to diminish in size as the static pressure of the gas/liquid mixture is increased during its transit through the mixing tube 4. Thus the flow forces aid in homogenizing the mixture.

At the bottom of the mixing tube 4, the flow is abruptly turned through an angle of close to 180 degrees by a deflection cap 5 and discharged through a plurality of passageways, each of which is bounded by a pair of spacers 7, the inner wall of the cap 5, and the outer wall of the mixing tube 4 (FIGS. 2, 3 and 6). Only the small bubbles that move with essentially the same velocity as the flow stream are able to make the turn; the larger bubbles are thrown against the walls of the deflection cap 5. Upon exiting the passageways, the flow is directed against a splatter wall in the form of flat disk 6 which the mixture strikes as it enters the holding tank 8. The combination of the sudden turning of the flow by the cap 5 and the striking of the disk 6 helps to break up any large bubbles remaining in the flow at the lower end of the tube 4. Large gas bubbles that do manage to escape being so broken rise to the top of the holding tube 8 and into the cavity 13, where the gas is reused.

For the remainder of the gas/liquid suspension which enters the tank B, the flow velocity and the static pressure of the flow are reduced and increased, respectively, causing the dissolved bubbles to reduce further in size. Dissolution of the gas in the liquid continues in the tank 8 until the gas/liquid suspension enters a transfer tube 9 via an union 25. At the end of the transfer tube 9, the flow is discharged at a predetermined depth through a valve 20 into a large body 26 of liquid. The valve 20 is used to control the level of the gas/liquid mixture in the holding tank 8. A sight glass 21 or other liquid indicator is provided so that one may check whether the proper fluid level is being maitained. Preferably, the fluid level is kept slightly below the holes 14 in the venturi assembly during operation. A pressure gauge 22 is included for use in checking on the pressure of the gas/liquid mixture.

In a preferred embodiment used for the oxygenation of water, water is supplied to the apparatus 10 at 40 gallons per minute and 35 psi pressure using a two horsepower pump. Housed in a holding tube 8 which, by way of example, is a 10 inch pipe 40 inches long, the venturi assembly includes an union 23, mixing tube 4 and plate 2 mounted on the end of the tube contiguous with the union (FIG. 3). The plate 2 preferably measures approximately $1\frac{5}{8}$ inch in diameter and has nine orifices $\frac{1}{4}$ inch in diameter so that approximately 25 percent of the area of the plate 2 is open to receive the water flow. In the embodiment illustrated in FIGS. 1–6, pure oxygen is fed into inlet 11 at 50 psi and enters the cavity 13 through twenty holes 14, each of which preferably measured 3/16 inch in diameter and extends through both a portion of the union 23 and the tube 4. Downstream of the plate 2, the gas/liquid mixture flows through the mixing tube 4 which in the preferred embodiment is a $1\frac{1}{2}$ inch tube 10 inches long. A two inch pipe cap mounted on the tube 4 serves as a deflection cap 5 and, with the use of spacers 7, provides flow passageways between the outer wall of the mixing tube 4 and the inner wall of the deflection cap 5. The disk 6 held in place both by the spacers 7 and a ring 28 measures, by way of example, 4.5 inch in diameter and is separated by a distance of $\frac{1}{4}$ inch from the proximate edge of the deflection cap 5. This combination allows oxygen to be absorbed in the water at 8 to 12 liters per minute depending on the water temperature.

I claim:

1. An apparatus for dissolving a gas in a liquid comprising:

(a) a orifice plate;

(b) an elongated mixing tube, one end of which is connected to the nozzle plate, the orifice plate having means for separating a liquid flow stream into a plurality of small streams, the small streams converging downstream of the orifice plate to establish a fluid level in the mixing tube; the orifice plate and a portion of the mixing tube disposed above the fluid level defining an injection chamber;

(c) means for introducing a gas into the injection chamber at a pressure higher than that of the liquid, so that a gas bubble/liquid mixture can be formed;

(d) means for abruptly deflecting the flow passing out of the mixing tube through an angle of approximately 180 degrees; the deflecting means including an annular wall surrounding one end of the mixing tube, the annular wall and the mixing tube defining the outer and inner surfaces, respectively, of at least one flow passageway and of at least one outlet for the mixing tube; the greatest transverse cross-sectional area of any region bounded by the inner surface of the annular wall and the outer surface of the mixing tube being substantially less than the greatest transverse cross-sectional area of the mixing tube;

(e) a splatter wall disposed downstream of the outlet and transversely to the longitudinal centerline of the mixing tube, the splatter wall being located sufficiently close to the outlet that the flow velocity is substantially reduced when the flow impinges upon said splatter wall; and (f) means for recovering most of the gas lost from gas bubble/liquid mixture after the flow impinges on the splatter wall and for reintroducing the gas which has been recovered into the injection chamber; and (g) means for discharging the flow after it impinges on the splatter wall at a point where the flow is needed for use.

2. In an apparatus for dissolution of a gas in a liquid having means for breaking a flow of the liquid into a plurality of small streams, means for introducing gas into said streams so that some of the gas dissolves in the liquid, means for combining the streams to form one resultant flow stream, means for capturing and reusing gas bubbles that are lost from the flow stream, and means for controlling the pressure at which flow is discharged from the apparatus, wherein the improvement comprises:

(a) an elongated mixing tube;

(b) the flow breaking means including a plate which is mounted on the upstream end of the mixing tube and which has a plurality of holes approximately $\frac{1}{4}$ inch in diameter, the plate being disposed transversely to the direction of the flow;

(c) means with an outlet for suddenly turning the resultant flow stream through an angle of approximately 180 degrees, the turning means directing the flow stream along the exterior walls of the mixing tube but in the opposite direction to that of the flow stream in the mixing tube immediately upstream of the turning means, so that large bubbles that move more slowly than the resultant flow stream velocity are unable to make the turn and crash into the turning means, breaking into smaller bubbles; and (d) a splatter wall disposed in the flow channel of the flow stream at a distance of about $\frac{1}{4}$ inch from the outlet, so that the forward velocity of the resultant flow steam is greatly reduced and large gas bubbles are broken up upon collision with the splatter wall.

3. An apparatus for dissolving a gas in a liquid comprising:

(a) an oifice plate having a plurality of orifices;

(b) means for forcing a liquid stream through the orifices, so that the liquid stream is broken into a plurality of smaller streams;

(c) means for introducing a gas into the smaller streams to form a gas/liquid flow, the gas introducing means comprising a plurality of gas inlets disposed generally perpendicularly to the flow through the orifices and immediately downstream of the orifice plate;

(d) means including a mixing tube to one end of which the orifice plate is connected for receiving the gas/liquid flow and further homogenizing the flow as it travels the length of the tube;

(e) means for abruptly reversing the direction of the flow as it exits the mixing tube and for simultaneously changing the flow from a flow wetting the interior wall of the mixing tube to a flow wetting the exterior wall of the mixing tube, the flow reversing means and the mixing tube defining at least one passageway through which the flow moves as it wets said exterior wall; the reversing means including an annular wall surrounding one end of the mixing tube, the annular wall and the mixing tube defining the outer and inner surfaces, respectively, of said passageway and of at least one exit for the mixing tube; the greatest transverse cross-sectional area of any region bounded by the inner surface of the annular wall and the outer surface of the mixing tube being substantially less than the greatest transverse cross-sectional area of the mixing tube;

(f) a splatter plate located less than one equivalent diameter of the flow channel through the reversing means from the exit of each passageway therethrough, so that any large gas bubbles in the flow that survived in the passageway can be broken up; and (g) a holding tank surrounding the mixing tube in which the gas/liquid flow may be further mixed prior to discharge.

4. An apparatus according to claim 3 wherein the reversing means further comprises:

(a) a cap including a generally cylindrical wall and a convex, rounded wall; the cylindrical wall being open at one end and closed at the other end by the rounded wall; the cylindrical wall having an inner diameter which is larger than the outer diameter of the mixing tube; the cylindrical wall surrounding one end of the mixing tube; and (b) at least one pair of spacers disposed between the mixing tube and the cylindrical wall; the mixing tube, the cylindrical wall, and the pair of spacers forming said passageway.

5. An apparatus according to claim 3 wherein a portion of the holding tank which is disposed above the fluid level therein forms a cavity in which gas that escapes being dissolved in the liquid can be reused in the plurality of gas inlets.

6. An apparatus according to claim 3 wherein the holding tank further comprises an outlet, the outlet being connected to means for inserting flow from the outlet into an utilization medium, the means for inserting the flow including a discharge pipe and a flow control means in close proximity to the end of the discharge pipe which may be at a distance which is many times greater in length than is the holding tank.

* * * * *